United States Patent [19]

Takagi et al.

[11] Patent Number: 4,563,610

[45] Date of Patent: Jan. 7, 1986

[54] DEVICE FOR GENERATING NEGATIVE-ION BEAMS BY ALKALINE METAL ION SPUTTERING

[75] Inventors: Toshinori Takagi, Nagaokakyo; Junzo Ishikawa, Mukou; Koji Matsuda, Kusatsu, all of Japan

[73] Assignee: Nissin-High Voltage Co., Ltd., Kyoto, Japan

[21] Appl. No.: 477,971

[22] Filed: Mar. 23, 1983

[30] Foreign Application Priority Data

Dec. 20, 1982 [JP] Japan ..... 57-223221

[51] Int. Cl.[4] ..... H01J 27/22; H01J 49/14; H05H 1/24

[52] U.S. Cl. ..... 313/362.1; 313/359.1; 313/363.1; 250/423 R

[58] Field of Search ..... 313/359.1, 360.1, 361.1, 313/362.1, 363.1; 250/423 R, 425, 427, 424

[56] References Cited

U.S. PATENT DOCUMENTS 3,233,404 2/1966 Huber et al. ..... 313/362.1 X 3,849,656 11/1974 Wallington ..... 313/362.1 X

FOREIGN PATENT DOCUMENTS 1063199 3/1967 United Kingdom ..... 313/363.1

*Primary Examiner*—David K. Moore
*Assistant Examiner*—K. Wieder
*Attorney, Agent, or Firm*—Stiefel, Gross, Kurland & Pavane

[57] ABSTRACT

A negative-ion source comprising means for discharging alkaline metal for discharging neutral alkaline metal particles together with alkaline metal ion particles; an electrode for generating negative ions which can serve as an extraction electrode for extracting said alkaline metal ion particles and a target bombarded with said alkaline metal ion particles and which provides with a hold for holding negative-ion seed material in the portion bombarded with said alkaline metal ion particles and an aperture for letting out negative-ion particles; and a negative-ion extraction electrode for said negative-ion particles. The present negative-ion source has an improved ion current efficiency and is compact size.

6 Claims, 2 Drawing Figures

DEVICE FOR GENERATING NEGATIVE-ION BEAMS BY ALKALINE METAL ION SPUTTERING

BACKGROUND OF THE INVENTION

1. Field of the Invention

This invention relates to a negative-ion source, and more particularly to a negative-ion source for generating negative-ion beams by alkaline metal ion sputtering.

2. Prior Art

As a known negative-ion source for generating negative ions by causing alkaline metal ion particles to collide against negative-ion source seed material in the presence of neutral alkaline metal particles, that is, for generating negative ions by alkaline metal ion sputtering, the disclosure of apparatus has already been made in the "NUCLEAR INSTRUMENTS AND METHODS 144(1977) (USA) pp. 373–399" and "NUCLEAR INSTRUMENTS AND METHODS 164 (1979) (USA) pp. 4–10".

The former apparatus is so constructed that it employs negative ion seed material made to stick in the form of a cone to the perimeter of an aperture made in a target plate and uses cesium as alkaline metal. It thereby accelerates, by means of an ion extraction electrode, cesium ion particles discharged from a cesium ion discharging assembly to make the particles collide against the negative-ion seed material; on the other hand, neutral cesium particles are supplied to the negative-ion seed material from a cesium oven installed independently of the above structure. The negative ions generated are extracted from the aperture of the target plate in a direction opposite to the cesium ion discharge assembly and accelerated by the negative-ion extraction electrode to form negative-ion beams. In the case of this apparatus, the advantage is that sputtering efficiency is quite high because cesium ion particles are accelerated, before being allowed to collide against the negative-ion seed material. However, it has this disadvantage, that it tends to be larger because the ion discharge assembly which is to provide cesium ions after accelerating them and the ion extraction electrode (these are used as the ion source of cesium ions) are independent of the cesium oven. Moreover, although it is possible to discharge neutral cesium particles as well as cesium ion particles from the cesium ion discharge assembly, the quantity of neutral cesium particles proceeding toward the target plate from the cesium ion discharge assembly is decreased because the ion extraction and suppressor electrodes stand between the cesium ion discharge assembly and the target plate and because the distance between the cesium ion discharge assembly and the target plate tends to become greater. Accordingly, the omission of the cesium oven is impossible.

On the other hand, the latter apparatus employs means for discharging ions in such a way as to supply neutral cesium particles to an ion discharge assembly for the purpose of generating cesium ion particles. negative-ion seed material is arranged in the ion discharge assembly. Cesium ion particles are made to collide with the negative-ion seed material immediately after being generated, then negative-ion particles are generated. Consequently, negative-ion particles are directly extracted from the ion discharge assembly. For this apparatus, the advantage is that its construction is free from complexity and can be made compact because it is unnecessary to separately provide a cesium oven. However, this apparatus is at a disadvantage in being unable to accelerate cesium ion particles sufficiently, thereby reducing the sputtering efficiency. In addition, another disadvantage is that the number of negative-ion particles that may be extracted is decreased because, when the generated negative-ion particles are being extracted through the plasma in the ion discharge assembly, some of them are destroyed.

SUMMARY OF THE INVENTION

This invention has been made in light of the foregoing and an object of the invention is therefore to provide a negative-ion source so constructed that it may sufficiently accelerate alkaline metal ion particles before permitting the ion particles to collide with negative-ion seed material and make it unnecessary to provide an separate alkaline metal oven.

In other words, the negative-ion source of the present invention comprises means for discharging alkaline metal, the means being able to discharge neutral alkaline metal particles together with alkaline metal ion particles; an electrode for generating negative ions which can serve as an extraction electrode for extracting the alkaline metal ion particles and a target to be bombarded with the alkaline metal ion particles and which provides means for holding negative-ion seed material in the portion bombarded with the alkaline metal ion particles and an aperture for letting out negative-ion particles; and a negative-ion extraction electrode for extracting negative ions.

When cesium is employed as alkaline metal in the negative-ion source according to the present invention, the means for discharging cesium basically consists of means for supplying neutral cesium particles, means for supplying energy for ionizing the neutral cesium particles, and an ionization chamber in which the neutral cesium particles are ionized. As the means for supplying neutral cesium, a known cesium crucible may be used. For the means for supplying energy and the ionization chamber, those used for a known ion source for extracting ions from the plasma such as an electron bombardment type ion source, PIG ion source or beam plasma type ion source may be employed. Means capable of discharging more neutral cesium particles from alkaline metal ion particles should preferably be selected.

In the negative-ion source according to the present invention, although the electrode for generating negative ions is basically similar in contruction to an ion extraction electrode in a known ion source, the difference between them is that in the present invention the electrode itself for generating negative ions is allowed to become the target, so that it has a portion located always within a sweep of ion beams. To be specific, for instance, when the electrode for generating negative ions is arranged in a location separated from the means for discharging cesium by any degree of distance, an aperture having a diameter smaller than that of the expanse of the cesium ion beams in that location is provided in the electrode and the electrode is installed so that the aperture is located within the beams. Moreover, when the electrode for generating negative ions is provided with an aperture with any having a given diameter, the electrode is installed in such a location that the expanse of the beams is larger than the diameter of the aperture, so that the aperture is located within the beams. In either case, the perimeter of the aperture becomes the portion bombarded with cesium ion particles.

Another difference lies in the fact that the electrode for generating negative ions according to the present invention has means for holding negative-ion seed material in its portion bombarded with cesium ion particles; in this regard, it is different from the conventional extraction electrode. The negative-ion seed material is bonded to the electrode and held thereon.

In the negative ion source according to the present invention, a known negative-ion extraction electrode may also be used.

DESCRIPTION OF THE PREFERRED EMBODIMENT

Referring now to the example illustrated, the detailed description of the present invention is given as follows; whereby other features and merits of the present invention will be made clear.

Figure 1:
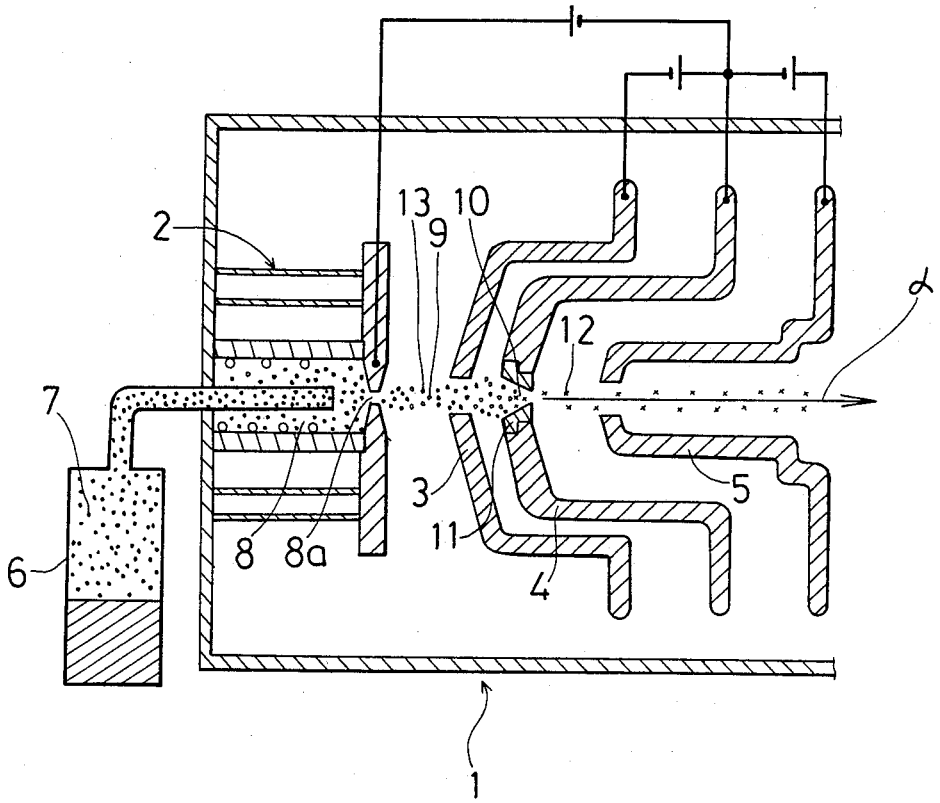
FIG. 1 is an explanatory view illustrating the typical structure of an example of a negative-ion source according to the present invention.

In FIG. 1, there is shown an example of the negative-ion source (1) according to the present invention, wherein the source comprises means (2) for discharging cesium, a suppressor electrode (3), an electrode for generating negative ions (4), and a negative-ion extraction electrode (5) arranged in this order.

As the means (2) for discharging cesium, the ion discharge of the electron bombardment type ion source is employed and neutral cesium particles (7) are supplied into an arc chamber (8*a*) from a cesium crucible (6). As a result, cesium ion particles (9) are emitted from an outlet (8) of the chamber. These cesium ion particles (9) are accelerated by the suppressor electrode (3) and the electrode (4) for generating negative ions and proceed to the righthand side in FIG. 1. Excessive neutral cesium particles (13) that have not been ionized are also jetted out of the outlet (8) to the right in FIG. 1.

Since the electrode (4) for generating negative ions is also used as an extraction electrode, it is arranged in the location not so far from the outlet (8). Consequently, a sufficient quantity of the neutral cesium particles (13) jetted out of the outlet (8) reaches the electrode (4) for generating negative ions.

The electrode (4) for generating negative ions is provided with an aperture (10) and negative-ion seed material (11) such as carbon is attached onto the perimeter of the aperture (10) in the shape of a cone. This negative-ion seed material (11) is arranged within the stream of accelerated cesium ion particles (9) so that the material (11) may be bombarded with the accelerated cesium ion particles (9).

A sufficient quantity of neutral cesium particles (13) is ultimately supplied to the negative-ion seed material (11), which is bombarded with the accelerated cesium ion particles (9) and therefore negative ion particles (12) are generated.

The negative-ion particles (12) are not allowed to proceed leftward because of the suppressor electrode (3) shown in FIG. 1. Those particles are extracted from the aperture (10) and led to the right in FIG. 1 because of the negative-ion extraction electrode (5) and then accelerated. Thus negative-ion beams shown by an arrow $\alpha$ in FIG. 1 are obtained.

Examples of tests for the negative-ion source according to the present invention are shown as follows:

Test 1

Means for discharging cesium: an ion discharge assembly of an electron bombardment type ion source was used.

Diameter of outlet: 2.2 mm$\phi$.

Spacing between the aperture of a suppressor electrode and an outlet: 6 mm.

Diameter of the aperture of the suppressor electrode: 6 mm$\phi$.

Spacing between the aperture of an electrode for generating negative ions and the outlet: 21 mm.

Diameter of the aperture of the electrode for generating negative ions: 2 mm$\phi$.

Spacing between the aperture of a negative-ion extraction electrode and that of the electrode for generating negative ions: 10 mm.

Diameter of the aperture of the negative-ion extraction electrode: 5 mm$\phi$.

Electric potential of the electrode for generating negative ions against a chamber for discharging cesium: $-20$ kV.

Electric potential of the suppressor electrode against the electrode for generating negative ions: $-1.3$ kV.

Negative-ion seed material: graphite (carbon).

Figure 2:
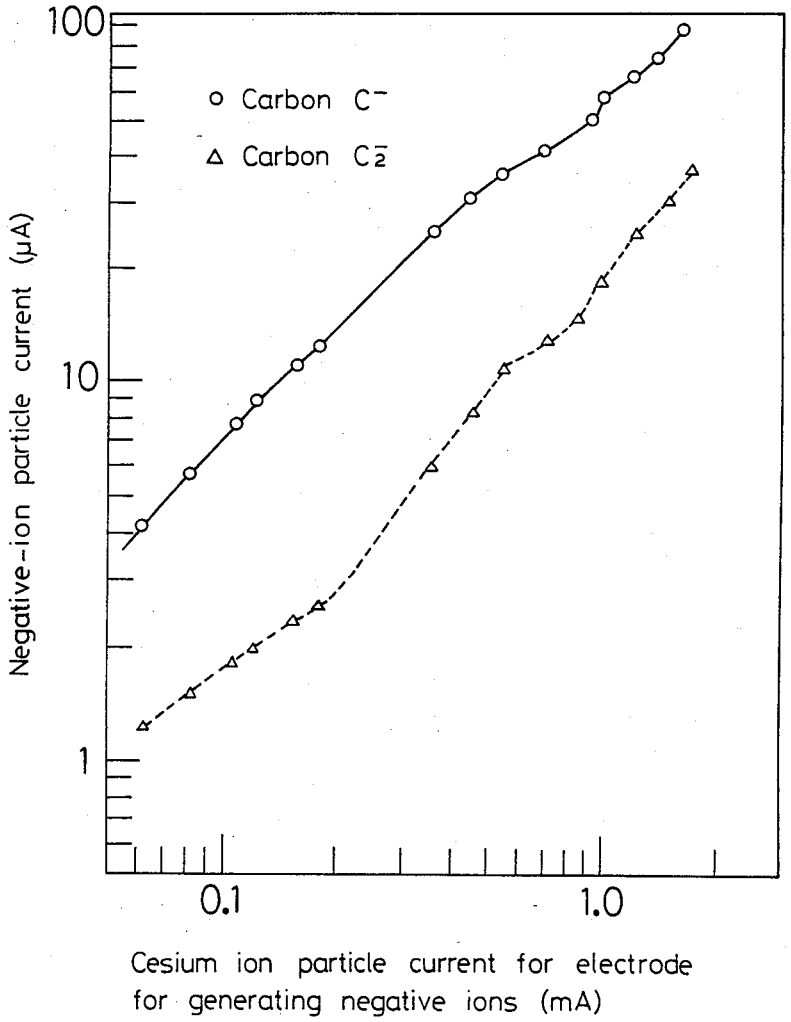
FIG. 2 is a graphic representation of test data on the negative-ion source according to the present invention.

Test data obtained under the above conditions are shown in FIG. 2, wherein the current of the negative-ion particle thus obtained shows far larger values than before. In the meantime, the current of the negative-ion particle according to the conventional negative-ion source is 30–50 $\mu$A when the current of the cesium ion particle is 1.0–1.5 mA and negative-ion seed material is carbon $C^-$ in an atomic state.

The negative-ion seed materials are carbon $C^-$ (marked with o in FIG. 2) and carbon $C_2^{-2}$ (marked with $\Delta$ in FIG. 2).

Further, other examples of the negative-ion seed materials are boron, antimony, copper and aluminum.

Alkaline metals in the terms "neutral alkaline metal particles" and "alkaline metal ion particles" are preferred to be cesium or rubidium and in principle shall be the same sort.

As has been described, the negative-ion source according to the present invention is so constructed that an electrode for extracting alkaline metal ion particles is also used as a target, which is allowed to hold negative-ion seed material, and ion discharge means of such a type as is capable of extracting ions from the plasma is employed so that alkaline metal ion and neutral alkaline metal particles are simultaneously supplied from that means. Accordingly, because the alkaline metal ion particles are thoroughly accelerated before being bombarded with the negative-ion seed material, high sputtering efficiency is attainable. Moreover, because the generated negative-ion particles are extracted without passing through the plasma, reduction in the quantity of negative-ion particles is not observed and more negative-ion particles are obtainable. In addition, because sufficient neutral alkaline metal particles are supplied from the means for discharging ions, it is unnecessary to provide an independent alkaline metal oven, so that a compact apparatus as a whole may be available.

As many apparently widely different embodiments of this invention may be made without departing from the spirit and scope thereof, it is to be understood that the invention is not limited to the specific embodiments hereof except as defined in the appended claims.

What is claimed is:

1. A negative ion source comprising means for discharging neutral alkaline metal particles together with alkaline metal ion particles; an electrode for generating negative ions which serves as an extraction electrode for extracting said alkaline metal ion particles and as a target for being bombarded with said alkaline metal ion particles and which is provided with means for holding negation-ion seed material in the portion bombarded with said alkaline metal ion particles and with an aperture for permitting negative-ion particles to exit; and a negative-ion extraction electrode for said negative ions.

2. A negative-ion source as claimed in claim 1, wherein said means for discharging alkaline metal comprises means for supplying said neutral alkaline metal particles, means for supplying energy for ionizing said neutral alkaline metal particles, and an ionization chamber wherein said neutral alkaline metal particles are ionized.

3. A negative-ion source as claimed in claim 2, wherein said means for supplying energy is a cathode of an electron bombardment type ion source and said ionization chamber is an arc chamber of said electron bombardment type ion source.

4. A negative-ion source as claimed in claim 1, wherein said means for holding negative-ion seed material is disposed on the perimeter of the aperture of electrode for generating negative ions for holding said negative-ion seed material in the shape of a cone expanding toward said means for discharging said alkaline metal.

5. A negative-ion source as claimed in claim 1, wherein said alkaline metal is cesium.

6. A negative-ion source as claimed in claim 1, wherein said alkaline metal is rubidium.

* * * * *